US012152788B2

(12) United States Patent
Westman et al.

(10) Patent No.: US 12,152,788 B2
(45) Date of Patent: Nov. 26, 2024

(54) CONTROL UNIT FOR A HOUSEHOLD APPLIANCE AND METHOD FOR CONTROLLING A HOUSEHOLD APPLIANCE

(71) Applicant: ELECTROLUX APPLIANCES AKTIEBOLAG, Stockholm (SE)

(72) Inventors: Elina Westman, Stockholm (SE); Katharina Baumgartner, Rothenburg ob der Tauber (DE); Walter Frost, Stockholm (SE); Alexandra Abalada, Stockholm (SE); Kim Rogvall, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 46 days.

(21) Appl. No.: 17/623,975

(22) PCT Filed: Jul. 2, 2020

(86) PCT No.: PCT/EP2020/068661
§ 371 (c)(1),
(2) Date: Dec. 30, 2021

(87) PCT Pub. No.: WO2021/008886
PCT Pub. Date: Jan. 21, 2021

(65) Prior Publication Data

US 2022/0397277 A1 Dec. 15, 2022

(30) Foreign Application Priority Data

Jul. 16, 2019 (EP) ..... 19186441

(51) Int. Cl.
*G06F 3/044* (2006.01)
*F24C 7/04* (2021.01)
(Continued)

(52) U.S. Cl.
CPC ..... *F24C 7/086* (2013.01); *F24C 7/046* (2013.01); *F24C 15/10* (2013.01)

(58) Field of Classification Search
CPC ..... G09G 3/044
See application file for complete search history.

(56) References Cited

U.S. PATENT DOCUMENTS 6,618,039 B1 * 9/2003 Grant ..... G06F 3/0238 345/169
2005/0237217 A1 * 10/2005 Rudolph ..... F24C 7/085 340/815.45

(Continued)

FOREIGN PATENT DOCUMENTS

DE 102011083344 3/2013
EP 1273851 1/2003

(Continued)

OTHER PUBLICATIONS

International Search Report and Written Opinion for PCT/EP2020/068661, dated Sep. 11, 2020, 8 pages.
EP Communication for 20735189.1, dated Aug. 4, 2023, 6 pages.

*Primary Examiner* — Sanghyuk Park
(74) *Attorney, Agent, or Firm* — Pearne & Gordon LLP

(57) ABSTRACT

The present invention relates to a control unit for a household appliance, in particular for a cooking appliance (1). The control unit comprises at least one input/output device (UI) for the entry of control commands and for the visualisation of information, particularly status information, and at least one control element (S1, S2, S3, S4) comprising a plurality of touch-sensitive switching elements positioned in a straightlined arrangement. At least a part of the input/output device (UI) is touch-sensitive and/or formed as a touch screen. The control element (S1, S2, S3, S4) is adapted to assign a power level to an electrical load depending on the activated switching element. At least one first special func- (Continued)

tion, in particular a first special operating program, is assignable to at least a first one of the plurality of switching elements. The input/output device (UI) further comprises at least one selection button (13, 15), which is adapted to provide the selection of the at least one first special function. The invention also relates to a cooking appliance comprising said control unit and a method for controlling a household appliance.

17 Claims, 3 Drawing Sheets

(51) Int. Cl.
*F24C 7/08* (2006.01)
*F24C 15/10* (2006.01)

(56) References Cited

U.S. PATENT DOCUMENTS

| | | | | |
|---|---|---|---|---|
| 2008/0110875 | A1* | 5/2008 | Fisher | F24C 7/082 219/483 |
| 2010/0196561 | A1 | 8/2010 | Kling et al. | |
| 2013/0056457 | A1* | 3/2013 | Lee | G06F 3/04883 219/620 |
| 2014/0170275 | A1* | 6/2014 | Bordin | G05B 19/045 99/325 |
| 2021/0100393 | A1* | 4/2021 | Bentley | F23N 5/203 |

FOREIGN PATENT DOCUMENTS

| | | |
|---|---|---|
| EP | 2065650 | 6/2009 |
| WO | 0129483 | 4/2001 |
| WO | 2006133976 | 12/2006 |

* cited by examiner

CONTROL UNIT FOR A HOUSEHOLD APPLIANCE AND METHOD FOR CONTROLLING A HOUSEHOLD APPLIANCE

The present invention relates to a control unit for a household appliance. The invention further relates to a method for controlling a household appliance.

Household appliances are usually operated by a user by entering commands into a user interface of the household appliance. Said commands may comprise setting parameters for the operating program and triggering the start thereof. For a cooking hob a user interface is known for example from EP 1 273 851 A2. The known user interface comprises a touch-sensitive strip adapted to set or change a parameter and further comprises an LED based display bar adapted to indicate the respective parameter value. The display bar is partitioned into several segments. The border of each segment is visualized by a rectangular line. The touch-sensitive strip is visualized by tapered lines indicating the direction of increasing or decreasing respective parameters.

It is an object of the present invention to provide a control unit for a household appliance and a method for controlling a household appliance with increased functionality.

A control unit for household appliance, in particular for a cooking appliance, comprises at least one input/output device for the entry of control commands and for the visualisation of information and at least one control element comprising a plurality of touch-sensitive switching elements positioned in a straight-lined arrangement. The switching elements are electronic switches, in particular power transistors, that are used to drive the induction coils with current at the desired frequency, for example in the range of 18 kHz up to 100 kHz. The visualized information may be status information of the household appliance, for example information about an activated program sequence. At least a part of the input/output device is touch-sensitive and/or formed as a touch screen. The control element, which may be a slide bar, is adapted to assign a power level to an electrical load depending on the activated switching element. According to the invention, at least one first special function, in particular a first special operating program, is is assignable to at least a first one of the plurality of switching elements. The input/output device further comprises at least one selection button, which is adapted to provide the selection of the at least one first special function. The selection button may also be a touch-sensitive switching element.

According to a specific embodiment, the at least one first special function is a cooking program for a cooking appliance, in particular for a cooking hob. Said cooking appliance may comprise a user interface with a control element with a plurality of switching elements, each one thereof representing a dedicated heating power level, which heating power level is assigned to a heating element or a heating zone of the cooking appliance upon actuating said switching element.

The control unit may also comprise a first indicating element, which is allocated to the at least one first switching element. In particular, the first indication element is a first symbol element indicating the at least one first special function. The display of the first indicating element may depend on the actuation of the selection button.

In a preferred embodiment, the first indicating element is arranged next to the at least one first switching element. In this way, a user of the household appliance can easily understand the relationship between switching element and indicating element, hence, the special function, which will be triggered when actuating the switching element.

According to embodiments, a second indicating element, in particular a second symbol element indicating a second special function, is allocated to at least a second one of the plurality of switching elements. The first and second indicating elements are preferably arranged on a first line, which is in parallel to the straight-lined arrangement of the switching elements.

Advantageously, a particular one of a plurality of lightening elements is allocated to each one of the plurality of switching elements. The plurality of lightening elements is preferably arranged on a second line, which is in parallel to the straightlined arrangement of the switching elements. The first and second lines are preferably arranged on opposite sides of the straight-lined arrangement of the switching elements.

According to a further aspect of the invention, a cooking appliance, in particular a cooking hob, especially an induction hob, is disclosed. The cooking appliance comprises in an embodiment a first and a second cooking zone. Said first and second cooking zones are operatable by respective first and second control elements. Each one of the first and second control elements comprises a plurality of touch-sensitive switching elements. The pluralities of touch-sensitive switching elements, both of the first control element and of the second control element, are positioned in straight-lined arrangements in parallel to each other. A first indicating element, in particular a first symbol element indicating the at least one first special function, is allocated to both at least one first switching element of the first control element and to at least one first switching element of the second control element. The at least one first switching element of the first control element and the at least one first switching element of the second control element may be positioned in a straight-lined arrangement together with the related first indicating element, said first indicating element preferably being positioned between the at least one first switching element of the first control element and the at least one first switching element of the second control element.

According to a further aspect of the invention, a method for controlling a household appliance, in particular a cooking appliance, is disclosed. The household appliance is operated by a control element comprising a plurality of touch-sensitive switching elements, preferably a slide bar. Said control element assigns a power level to an electrical load, preferably to an electrical heating element, depending on the activated one of the plurality of switching elements. According to the invention, at least one first special function, in particular a first special operating program, is assigned to at least a first one of the plurality of switching elements on activation of at least one selection button arranged on the input/output device, and the at least one first special function is activated by actuating the at least first one of the switching elements.

Particularly, the function of power level assignment is deactivated and the provision of selection of a special function is activated on actuation of the selection button. Only one of the two functionalities of the control element may be available at the same time and the current functionality is selected by the current state, actuated or de-actuated, of the selection button.

A particular one of a plurality of lightening elements may be allocated to each one of the plurality of switching elements and on actuation of the selection button the lightening element allocated to a switching element, which is assigned with a special function, is switched on. By activation of the lightening element, it is indicated to the user that the related switching element can be actuated effectively, and its actuation may result is in the activation of the special function. Simultaneously, at least a portion of further activated lightening elements may be switched off.

The method is particularly further characterized in that upon activation of a special function, subsequent to its selection, the plurality of lightening elements light up successively depending on an increase of a parameter value, in particular of a temperature value, or depending on a program sequence.

When at least one special function is being activated, the appliance has a heat-up phase, to heat up until the boiling or frying temperature is reached, and after heating up a simmering phase.

A preferred embodiment is characterized by a dedicated time duration, which is determined for the at least one special function, in particular for the first special operating program. Said dedicated time duration, especially for the simmering phase, is displayed on a time display unit, which is arranged on the input/output device, upon selection of the at least one special function. The dedicated time duration may be predetermined and may preferably be modifiable by the user of the household appliance.

The time display unit may display the actual residual time during the program sequence and/or on expiry of the dedicated time duration the function of power level assignment may be reactivated.

In a preferred embodiment, the time display unit displays the actual residual time during the program sequence and/or the input/output device displays while the simmering phase the assigned power level.

Preferably, the time value of the time display unit and the power level, in particular during the simmering phase, for the special function are adjustable and/or modifiable. In addition, the adjusted time value and modified power level are saved in a memory of the control unit, so that when a special function is activated the last used combination of time value and power level in the simmering phase for the special function is used instead of the default settings.

A specifically preferred embodiment of the method provides for a predetermined power level, which is particularly assigned to a final step of the at least one first special function, more particularly to a final step of the first special operating program, which predetermined power level is assigned to the electrical load, preferably to the electrical heating element. The assigned power level is indicated by the plurality of lightening elements, particularly by the lightening element, which is allocated to the switching element representing the respective power level.

Novel and inventive features of the present invention are set forth in the appended claims.

The present invention will be described in further detail with reference to the drawings, in which FIG. 1 is a top view of a cooking hob comprising four cooking zones and a user interface;

Figure 1:
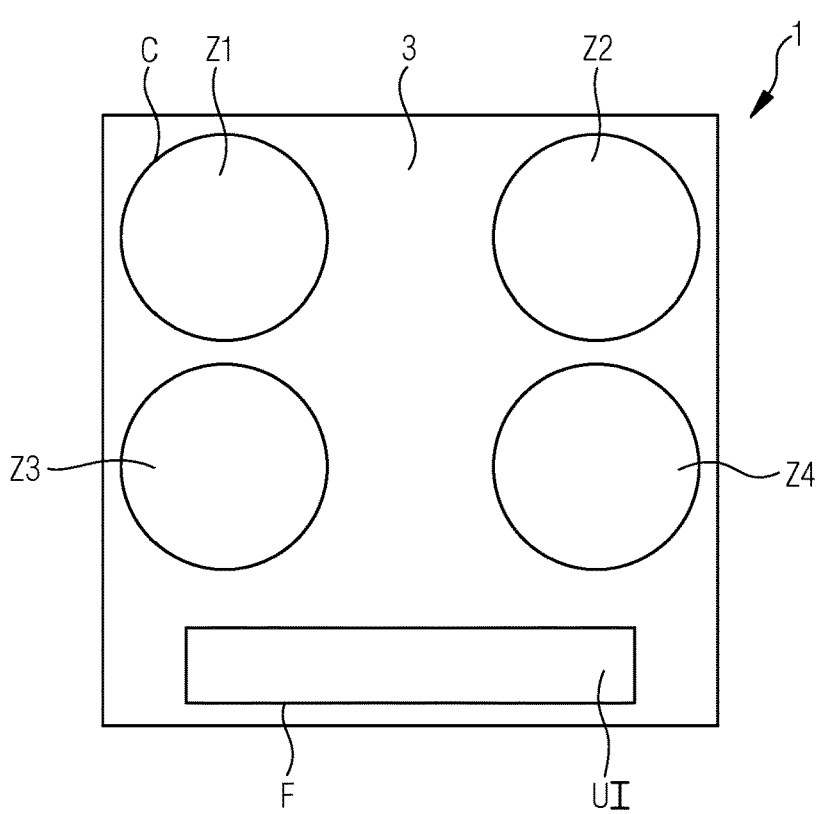

FIG. 1 illustrates an induction cooking hob 1 comprising four heating zones Z1, Z2, Z3, Z4, which are heated by induction heating coils (not shown) and indicated by means of four circular lines C arranged on a top plate 3 of the induction cooking hob 1. The top plate 3 is made of a semi-transparent glass plate comprising permanent printing such as the circular lines C for the heating zones Z1, Z2, Z3, Z4. The induction cooking hob 1 further comprises a user interface UI for the interaction between cooking hob 1 and its user, which is particularly adapted for receiving control commands from the user and forwarding them to a control unit, as well as providing information to the user by means of acoustical or optical signals.

Figure 2:
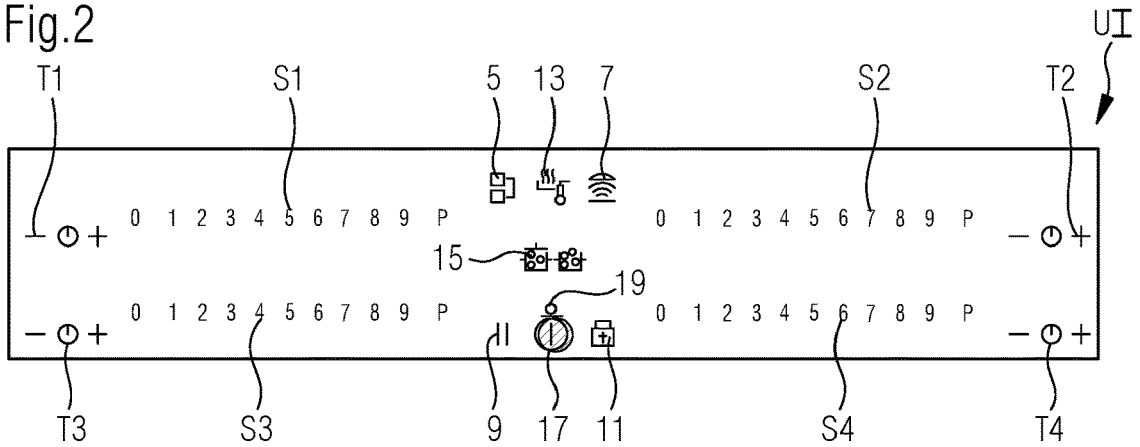
FIG. 2 is detail view of the user interface of the cooking hob according to FIG. 1.

Said user interface UI is illustrated with more details in particular with FIG. 2. It is covered by a rectangular device arranged beneath the top plate 3 and indicated by a rectangular frame line F (see FIG. 1), also by way of permanent printing. The user interface UI is formed as a touch screen comprising touch-sensitive operating elements. In order to operate the four cooking zones Z1, Z2, Z3, Z4, four related control elements S1, S2, S3, S4, which are designed as touch-sensitive slide bars, are arranged geometrically in a way that the user is able to easily identify the clear assignment in pairs between cooking zones Z1, Z2, Z3, Z4 and related slide bars S1, S2, S3, S4. Each slide bar S1, S2, S3, S4 comprises the numerical symbols from "0" to "9" and the letter symbol "P". Beneath each one of these symbols a touch-sensitive switching element is arranged and allows the user, according to a first functionality of the slide bars S1, S2, S3, S4, to set a power level with which the related heating zone Z1, Z2, Z3, Z4 is operated. While the letter "0" represents "no power" and the letter "9" represents "maximum permanent power", the letters in between represent intermediate power levels. With "P" a boost function is available, which supplies the heating zone Z1, Z2, Z3, Z4 with a temporary power level exceeding the "maximum permanent power", for a speeded heating-up. The user can enter the desired power level by directly touching the representing symbol or by sliding with a finger from the actual state to the desired power level, i.e. the respective symbol.

Usually, the entered power level is kept for the related heating zone Z1, Z2, Z3, Z4 until a modification or a total switch-off by the user. However, each of the heating zones Z1, Z2, Z3, Z4 can be automatically switched off after a set operating time. To this end, each slide bar S1, S2, S3, S4 is provided with a related timer T1, T2, T3, T4 comprising a clock symbol and key as well as "–" and "+" symbols and keys. The timer can be set by touching the clock symbol and incremental time modification by touching the "+" key or decremental time modification by touching the "–" key. A set operating period is indicated by a two-digit number illuminated by means of two seven-segment displays arranged above the clock and "–" and "+" symbols, as can be seen for example in FIG. 6. The set operating time (in minutes) is counted down, constantly indicating the residual time, and the heating zone Z1, Z2, Z3, Z4 is switched off when the timer indicates residual time "00".

The user interface UI further comprises symbols and related keys for combining heating zones, indicated by 5, for the function "Hob to Hood connection", indicated by 7, for a "Pause" function, indicated by 9, and for "key lock", indicated by 11. These symbols and keys will not be described herein in more detail.

Further, the user interface UI comprises also the symbols and keys for triggering special functions, indicated by 13 and 15, which special function will be described further down below.

Finally, the user interface UI is also equipped with a symbol for "Power ON/OFF" 17. As can be seen in FIG. 2, the user touches the "Power on/off" key 17, therewith switching on the cooking hob 1, causing a LED 19 to be switched on, which indicates the power-on state.

Like the circular lines C for heating zones indication and the rectangular frame F for user interface indication, the abovementioned slide bars S1, S2, S3, S4, the timer symbols T1, T2, T3, T4 and the further symbols 5, 7, 9, 11, 13, 15, 17 are illustrated by permanent printing.

As mentioned above, setting a power level for the heating zones Z1, Z2, Z3, Z4 by means of the slide bars S1, S2, S3, S4 is an operational mode of the cooking hob 1 according to a first functionality. A second functionality is provided by the cooking hob 1 in the option to select a special operating program, which may be a special function in the context of an automated cooking process. As will be now described in the following with reference to FIGS. 3 to 11, all of them basically reproducing the is user interface UI according to FIG. 2, the instant induction cooking hob 1 comprises the special operating functions "Sense Fry" and "Sense Boil", which may be used by the user for automated frying and boiling cooking processes, partially adapted to specific food to be cooked.

For the sake of clearness, reference signs will be repeated in FIGS. 3 to 11 from FIG. 2 only, when needed for the description and understanding of the current step.

With reference to FIGS. 3 to 7, the special operating program "Sense Boil" will be explained by way of the user interface UI illustrating the different optical signals shown to the user during the single operational steps.

Figure 3:
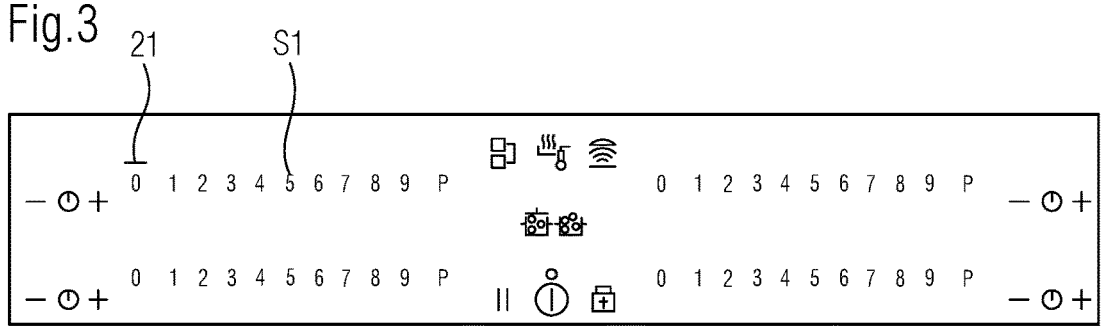
FIGS. 3, 4 illustrate the user interface of FIG. 2 according to a first functionality of a cooking hob operation.

FIG. 3 illustrates the state of the user interface UI after having been switched on by means of the Power ON/OFF key 17, as already described under the explanations for FIG. 2. A pot is also placed on the rear left-hand heating zone Z1. A pot detection equipment comprised by the induction cooking hob 1 has identified the pot placement and a small rectangular LED strip 21 above the numerical symbol "0" indicates that the slide bar S1 allocated to heating zone Z1 is triggered for expecting a user input on how to operate the heating zone Z1.

Figure 4:
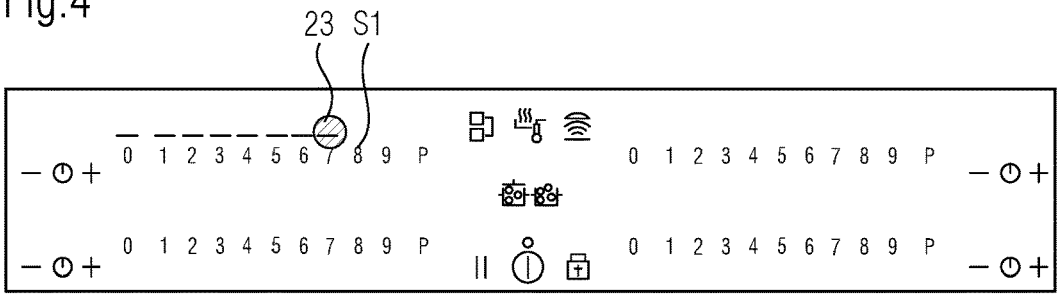

The user can now set a power level for the heating zone Z1 as illustrated with FIG. 4. For example, the user can touch the symbol and key for power level "7" (indicated by the small circular touch point 23) on slide bar S1. Consequently, the heating zone Z1 will be operated with a power level between a medium and a high level as long as not modified or switched off by the user.

Figure 5:
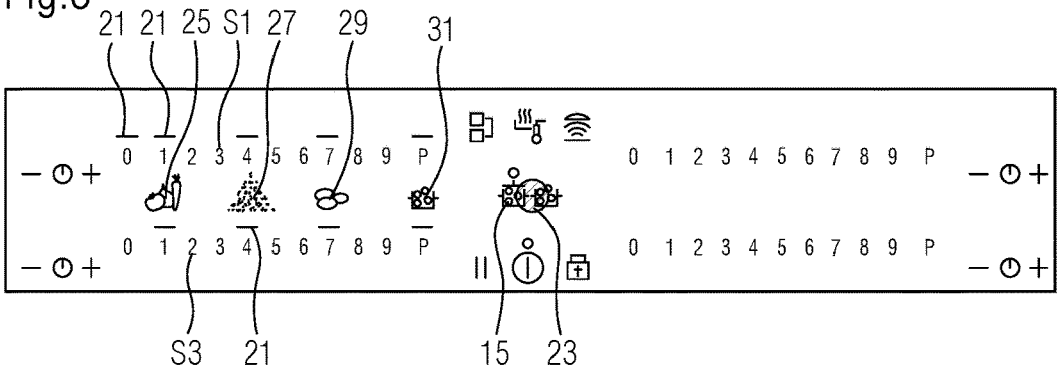
FIGS. 5 to 7 illustrate the user interface of FIG. 2 according to a second functionality of a cooking hob operation, operated with a first specific cooking program.

Alternatively, the user may decide to operate the heating zone Z1 by the special operating function "Sense Boil", as illustrated with FIG. 5. Said special operating function is started by touching the symbol and key "Sense Boil" 15 (see again the small circular touch point 23), represented by two pot symbols containing a boiling fluid. A first one of these pot symbols comprises a lid, the second one is without a lid. Actually, this symbol is a pair of symbols, representing special operating programs, and the user has to select the specific one which is adapted to the used cookware depending on a lid usage. Only one key, i.e. touch-sensitive switching element is utilized and a selection is realized by a potentially repeated touching.

After opening the special operating program "Sense Boil", the user can select one of the boil program options "Vegetable Boiling", indicated by 25, "Rice Boiling", indicated by 27, "Potato Boiling", indicated by 29, and "Water Boiling", indicated by 31. The symbols for said boiling programs light up after the user's selection of the special operating program "Sense Boil", together with related respective small rectangular LED strips 21 above the symbols "1", "4", "7" and "P", both for slide bar S1 and for slide bar S3. Said indication with the small rectangular LED strips 21 at both slide bars S1, S3 indicate that the special operating programs are available for the heating zones Z1 and Z3. However, since only a pot has been detected on heating zone Z1, selection of one of the afore-mentioned boil program options on slide bar S1 can effectively made for operating only heating zone Z1 accordingly.

Figure 6:
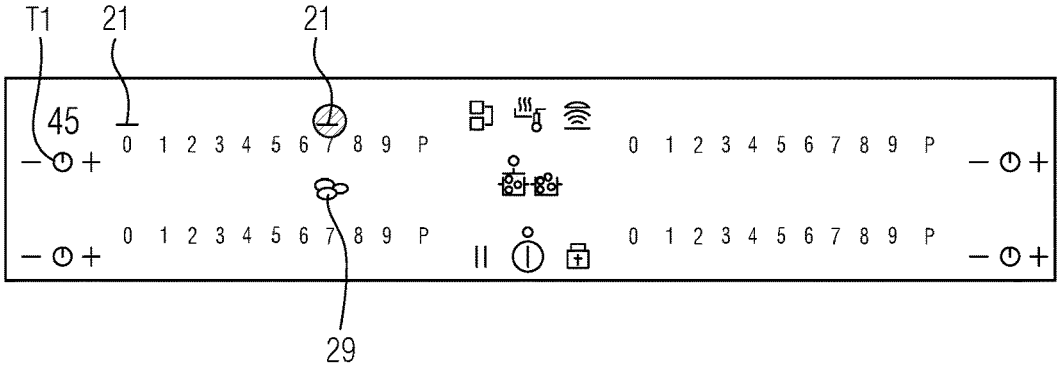

Currently, as illustrated with FIG. 6, the user selects the "Potato Boiling" program for heating zone Z1 by touching the touch-sensitive key or switching element represented by numerical symbol "7" (see again the small circular touch point 23). Consequently, all lightening elements at slide bars S1 and S3 except is the symbol "Potato Boiling" disappear. The related small rectangular LED strip 21 above the numerical symbol "7" also disappears while running the program. Also the small rectangular LED strip 21 above the numerical symbol "0", indicating the heating zone Z1 being occupied by a pot, remains illuminated. In addition, on selection of the "Potato Boiling" program the simmering phase of the "Potato Boiling" program, that runs 45 minutes, is shown by the timer T1 by illuminating the number "45" by means of the related two-digits seven-segment display.

During the "heat-up phase" and "simmering phase" the user can adjust the boil program duration time. This means that the presented cooking time at the timer T1 can be decreased and/or increased manually. The set time for the "simmering phase" can be decreased by pushing the "−" symbol or increased by pushing "+" symbol below the timer T1. The adjusted time for the boil program duration is stored in memory and is presented the next time the program is activated.

For example the user can also adjust the power within a range of +/−5, in particular +/−4, especially +/−3, preferably +/−2, of the default value to tweak the "simmering phase".

The system remembers the user's preference for each combination and the preferenced settings of the user will be proposed instead of the default, when the user selects the boiling program 25, 27, 29, 31. This means, that the adjusted time value and adjusted power value for the "simmering phase" for the selected boiling program is being saved and will replace the default settings by activating the boiling program 25, 27, 29, 31.

The user can reset each boil program individually by long pressing the symbol for the boil program 25, 27, 29, 31. When touching one of the symbols for the boiling program 25, 27, 29, 31 the previous settings are loaded and the "heat-up phase" is starting. If the user holds the symbol of the boiling program 25, 27, 29, 31 for at least one second, preferably two seconds, there will be a sound signal to inform the user that his input has been accepted. After the sound signal the "heat-up phase" continues with the default settings.

Figure 7:
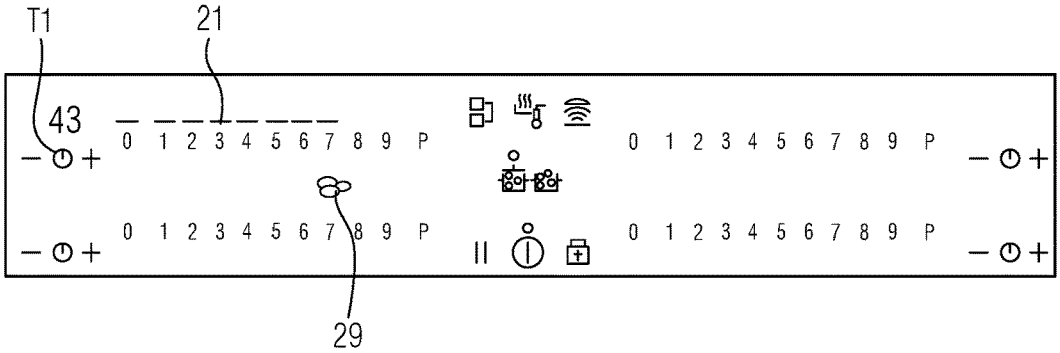

FIG. 7 illuminates a following step during the program course. As indicated by the number "43" in the timer T1 display, the timer digits count down and the slide bar S1, namely the small rectangular LED strips 21 above the numerical symbols and the "P" symbol, light up gradually until all of them are illuminated. When the timer is done, i.e. when reaching "00" (not shown), the cooking process is completed. The progress animation is stopped and a completion sound is emitted.

Further, with reference to FIGS. 8 to 11, the special operating program "Sense Fry" will be explained also by way of the user interface UI illustrating the different optical signals shown to the user during the single operational steps.

Figure 8:
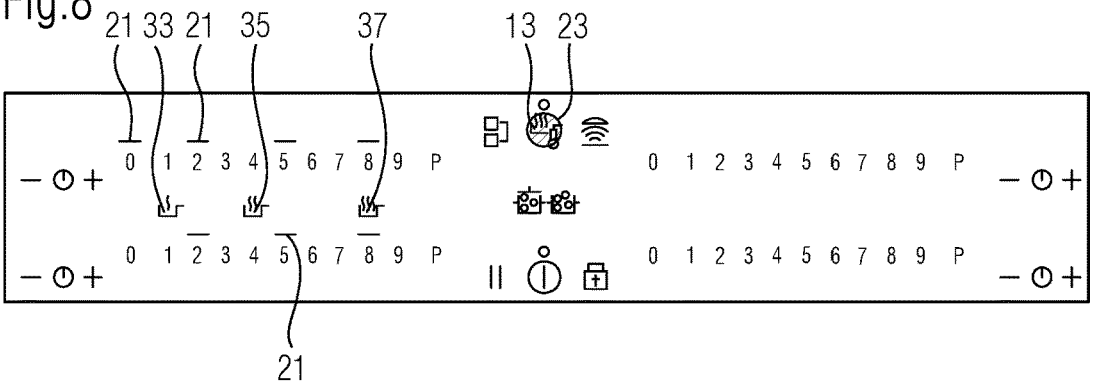
FIGS. 8 to 11 illustrate the user interface of FIG. 2 according to a second functionality of a cooking hob operation, operated with a second specific cooking program.

The user may decide to operate the heating zone Z1 by the special operating function "Sense Fry", as illustrated with FIG. 8. Said special operating function is started by touching the symbol and key "Sense Fry" 13 (see again the small circular touch point 23), represented by a pan symbol containing a frying food.

After opening the special operating program "Sense Fry", the user can select one of the fry program options "Low Frying", indicated by 33, "Medium Frying", indicated by 35, and "High Frying", indicated by 37. The symbols for said frying programs light up after the user's selection of the special operating is program "Sense Fry", together with related respective small rectangular LED strips 21 above the symbols "2", "5", and "8", both for slide bar S1 and for slide bar S3. Said indication with the small rectangular LED strips 21 at both slide bars S1, S3 indicate that the special operating programs are available for the heating zones Z1 and Z3. However, since only a pan has been detected on heating zone Z1, selection of one of the afore-mentioned fry program options on slide bar S1 can effectively made for operating only heating zone Z1 accordingly.

Figure 9:
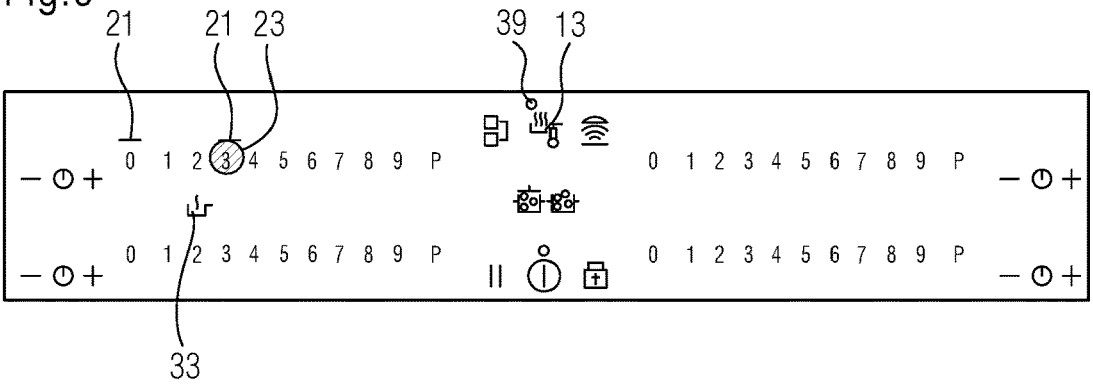
Figure 10:
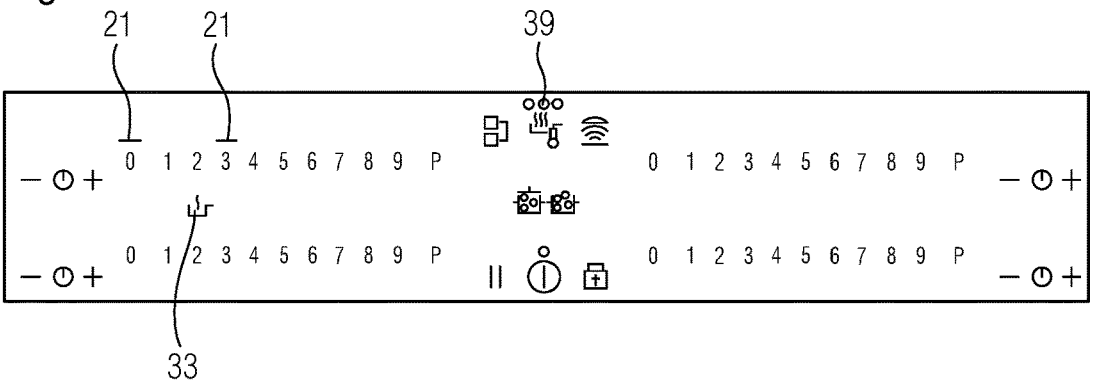

Currently, as illustrated with FIG. 9, the user selects a "Low Frying" program for heating zone Z1 by touching the touch-sensitive key or switching element represented by numerical symbol "3" (see again the small circular touch point 23). Consequently, all lightening elements at slide bars S1 and S3 except the symbol "Low Frying" and the related small rectangular LED strip 21 above the numerical symbol "3" disappear. Also the small rectangular LED strip 21 above the numerical symbol "0", indicating the heating zone Z1 being occupied by a pan, remains illuminated.

As can be seen from the two examples above, there are two major differences between the special operating programs "Sense Boil" and "Sense Fry" with respect to effective activation of switching elements of the slide bar S1. According to a first difference, when using the special operating program "Pro Boil", only the keys or switching elements directly next to the symbol 25, 27, 29, 31 for the related program option can be selected, whereas all keys or switching elements, representing different power levels, can be selected for the "Sense Fry" operating program. The program option closest to the selected numerical symbol stays on, i.e. in the current example the symbol for "Low Frying". According to a second major difference, the program progress is indicated by switching-on a respective number of is small circular LEDs above the symbol "Sense Fry" 13. During the program course a number of one, two or three LEDs 39 are first flashing and later on constantly switched on. At the end of the program all three LEDs 39 are constantly illuminated, indicating said program end, see FIG. 10.

Figure 11:
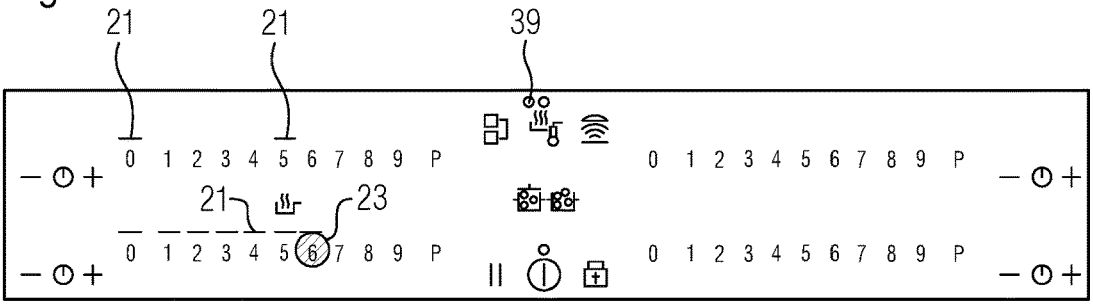

FIG. 11 finally illustrates the usage of two heating zones Z1, Z3 in parallel. The user has already selected the special operating program "Sense Fry" on heating zone Z1, indicated on slide bar S1 as described above (in this example with selected "Medium Frying", level "5"). In a next step the user selects conventional operation according to the first functionality, selecting power level "6", see again the small circular touch point 23 and respective indication by small rectangular LED strips 21 for the selected power level.

Although an illustrative embodiment of the present invention has been described herein with reference to the accompanying drawing, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

1 induction cooking hob
3 top plate
5,7,9,11,
13,15,17 different symbols and keys
19 LED Power on
21 rectangular LED strip
23 circular touch point
25,27,29,31 boiling program options
33,35,37 frying program options
39 circular LEDs
Z1,Z2,Z3,Z4 heating zones
S1,S2,S3,S4 slide bars
T1,T2,T3,T4 timers
C circular line
F rectangular frame line
UI user interface

The invention claimed is:

1. A control unit for a cooking appliance, comprising:
a touch-sensitive input/output device for entry of control commands and for visualisation of information, and
a control element comprising a plurality of touch-sensitive switching elements positioned in a straight-line arrangement, the control element being adapted to assign a power level to an electrical load depending on which of its switching element is activated,
wherein a first special operating program is assignable to a first one of the plurality of switching elements,
wherein the input/output device further comprises a selection button adapted to assign said first special operating program to said first switching element,
wherein upon assigning said first special operating program to said first switching element, touching said first switching element no longer results in controlling a heating element according to an associated power level but instead constitutes an input to the first special operating program, and
wherein said first special operating program is an automated cooking process.

2. The control unit according to claim 1, wherein a first symbol element indicating the first special function is allocated to the first switching element.

3. The control unit according to claim 2, wherein display of the first symbol element depends on actuation of the selection button.

4. The control unit according to claim 2, wherein the first symbol element is arranged next to the first switching element.

5. The control unit according to claim 2, wherein a second symbol element indicating a second special function is allocated to a second one of the plurality of switching elements, the first and second indicating elements being arranged on a first line extending parallel to the straight-lined arrangement of the switching elements.

6. The control unit according to claim 1, wherein a plurality of lightening elements are allocated respectively to each one of the plurality of switching elements, the plurality of lightening elements being arranged on a second line extending parallel to the straight-lined arrangement of the switching elements, the first and second lines being arranged on opposite sides of the straight-lined arrangement of the switching elements.

7. A cooking hob, comprising the control unit according to claim 1.

8. The cooking hob according to claim 7, further comprising a first cooking zone and a second cooking zone, said first and second cooking zones being operatable respectively by a first said control element and a second said control element wherein the straight-lined arrangements of the respective pluralities of touch-sensitive switching elements of said first and second control elements are parallel to each other, wherein a first symbol element indicating the first special operating program is allocated to both the first switching element of the first control element and to the first switching element of the second control element.

9. A method for controlling a cooking appliance, which is operated by a control element comprising a plurality of touch-sensitive switching elements, which control element assigns a power level to an electrical load depending on which for said switching elements is activated, wherein a first special operating program is assigned to a first one of the plurality of switching elements on activation of a selection button arranged on an input/output device of the cooking appliance, and the first special operating program is activated by actuating the first one of the switching elements, wherein upon assigning said first special operating program to said first switching element, touching said first switching element no longer results in controlling a heating element according to an associated power level but instead constitutes an input to the first special operating program, and wherein said first special operating program is an automated cooking process.

10. The method according claim 9 wherein a plurality of lightening elements are allocated respectively to each one of the plurality of switching elements and on actuation of the selection button the lightening element allocated to the first switching element, which is assigned with said special operating program, is switched on.

11. The method according to claim 9, wherein upon activation of said special operating program subsequent to its selection the plurality of lightening elements light up successively depending on an increase of a parameter value, or depending on a program sequence.

12. The method according to claim 9, wherein a dedicated time duration is determined for the first special operating program, said dedicated time duration being displayed on a time display unit, which is arranged on the input/output device, upon selection of the special operating program.

13. The method according to claim 12, wherein the time display unit displays actual residual time during a program sequence and/or the input/output device displays after a heat-up phase an assigned power level.

14. The method according to claim 13, wherein the time value of the time display unit and the power level of the special operating program are adjustable.

15. A cooking hob comprising:

a top plate comprising heating zone having an associated heating element;

a user interface comprising a touch screen actuatable via touch at an upper surface of said top plate;

and a controller adapted to control said heating element in response to user inputs via said user interface, the controller comprising a plurality of switching elements arranged linearly and corresponding to respective, linearly arranged indicia associated with said touch screen, wherein a touch on one of said indicia actuates the corresponding switching element, wherein in a normal operating mode, the controller is configured to operate said heating element according to a user-selectable power level based on touching a corresponding one of said indicia, wherein upon user actuation of a first selection button of the user interface, the controller is configured to assign a first special operating program to a first switching element of the plurality of switching elements and to illuminate a first special symbol associated with said first switching element corresponding to the first special operating program, such that touching said first switching element no longer results in controlling the heating element according to its associated power level but instead constitutes an input to the first special operating program, and wherein the first special operating program is an automated cooking process.

16. The cooking hob according to claim 15, wherein upon user actuation of said first selection button, the controller is configured to assign a second special operating program to a second switching element of the plurality of switching elements and to illuminate a second special symbol associated with said second switching element corresponding to the second special operating program, such that touching said second switching element will no longer result in controlling the heating element according to its associated power level but instead will constitute an input to the second special operating program; said first and second special symbols being arranged along a first line parallel to said linearly arranged indicia.

17. The cooking hob according to claim 16, said controller being further configured such that, after actuation of said first selection button, touching either said first switching element or said second switching element will result in the controller initiating the first special operating program or the second special operating program, respectively, and illuminating lightening elements allocated respectively to the plurality of switching elements according to a program sequence related to the initiated operating program, said lightening elements being arranged along a second line parallel to said first line and located opposite thereto relative to the linearly arranged switching elements.

* * * * *